US009351080B2

(12) United States Patent
Nabata et al.

(10) Patent No.: US 9,351,080 B2
(45) Date of Patent: May 24, 2016

(54) ELECTRONIC DEVICE INCLUDING STIFFNESS VARYING PORTION ON HOUSING

(71) Applicant: KYOCERA CORPORATION, Kyoto (JP)

(72) Inventors: Toshihisa Nabata, Sagamihara (JP); Satoshi Mizuta, Sagamihara (JP); Tomoaki Miyano, Kameyama (JP); Kiyokazu Sato, Yokohama (JP); Akio Kihara, Kawasaki (JP); Shun Kazama, Yokohama (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 13/871,774

(22) Filed: Apr. 26, 2013

(65) Prior Publication Data

US 2013/0287242 A1 Oct. 31, 2013

(30) Foreign Application Priority Data

Apr. 26, 2012 (JP) ..... 2012-101154

(51) Int. Cl.
*H04R 17/00* (2006.01)
*H04R 7/04* (2006.01)
*H04R 1/28* (2006.01)

(52) U.S. Cl.
CPC ..... *H04R 17/00* (2013.01); *H04R 1/2888* (2013.01); *H04R 7/045* (2013.01); *H04R 2201/029* (2013.01); *H04R 2499/11* (2013.01); *H04R 2499/15* (2013.01)

(58) Field of Classification Search
CPC .... H04R 17/00; H04R 17/10; H04R 2217/00; H04R 2217/01; H04R 1/00; H04R 1/02; H04R 1/021; H04R 1/026; H04R 1/16; H04R 1/18; H04R 1/28; H04R 1/2807; H04R 1/2892; H04R 2400/03; H04R 2460/13
USPC ..... 381/388, 386, 87, 332–336, 151; 312/223.1–223.4; 455/575.1, 90.3, 455/128, 347–350
See application file for complete search history.

(56) References Cited

U.S. PATENT DOCUMENTS 6,922,574 B2 * 7/2005 Abbasi et al. ..... 455/575.5
8,306,500 B2 * 11/2012 Tho et al. ..... 455/347

(Continued)

FOREIGN PATENT DOCUMENTS

EP 2651103 A2 10/2013
EP 2651104 A1 10/2013

(Continued)

OTHER PUBLICATIONS

The extended European search report issued by the European Patent Office on Apr. 23, 2014, which corresponds to EP13165510.2-1910 and is related to U.S. Appl. No. 13/871,774.

(Continued)

*Primary Examiner* — Paul S Kim
*Assistant Examiner* — Sabrina Diaz
(74) *Attorney, Agent, or Firm* — Studebaker & Brackett PC

(57) ABSTRACT

An electronic device (1) is provided with a piezoelectric element (30), a panel (10) holding the piezoelectric element (30), and a housing (60) holding the panel (10) and transmitting vibration through the panel (10). The electronic device (1) causes the panel (10) to generate vibration sound that is transmitted by vibrating a part of a human body. The electronic device (1) includes a stiffness varying portion (62, 63) in which the stiffness of the housing (60) varies.

13 Claims, 9 Drawing Sheets

(56) References Cited

U.S. PATENT DOCUMENTS

| | | | | |
|---|---|---|---|---|
| 8,680,746 | B2 * | 3/2014 | Takahashi et al. | 310/323.02 |
| 2006/0093165 | A1 | 5/2006 | Kamimura et al. | |
| 2006/0140424 | A1 * | 6/2006 | Kobayashi | 381/190 |
| 2006/0227981 | A1 * | 10/2006 | Miyata | 381/124 |
| 2009/0103767 | A1 | 4/2009 | Kuroda et al. | |
| 2010/0278362 | A1 * | 11/2010 | Kim | 381/151 |
| 2013/0175911 | A1 * | 7/2013 | Senatori | 312/223.1 |
| 2013/0267278 | A1 | 10/2013 | Nabata et al. | |
| 2013/0272549 | A1 | 10/2013 | Nabata et al. | |

FOREIGN PATENT DOCUMENTS

| | | | | |
|---|---|---|---|---|
| JP | H10-9172 | A | 1/1998 | |
| JP | 2000-043872 | A | 2/2000 | |
| JP | 2004-187031 | A | 7/2004 | |
| JP | 2005-348193 | A | 12/2005 | |
| JP | 2007-082009 | A | 3/2007 | |
| JP | 2009-290363 | A | 12/2009 | |
| JP | 2011-091719 | A | 5/2011 | |
| KR | 10-1068254 | * | 9/2011 | H04B 1/40 |

OTHER PUBLICATIONS

An Office Action; "Notice of Reasons for Rejection," issued by the Japanese Patent Office on Jun. 2, 2015, which corresponds to Japanese Patent Application No. 2012-101154 and is related to U.S. Appl. No. 13/871,774; with English language concise explanation.

* cited by examiner

ELECTRONIC DEVICE INCLUDING STIFFNESS VARYING PORTION ON HOUSING

CROSS REFERENCE TO RELATED APPLICATION

This application claims priority to and the benefit of Japanese Patent Application No. 2012-101154 (filed on Apr. 26, 2012), the entire contents of which are incorporated herein by reference.

TECHNICAL FIELD

Embodiments discussed herein relate to an electronic device that vibrates a panel by applying a predetermined electric signal (audio signal) to a piezoelectric element and that transmits air-conducted sound and vibration sound to a user by transmitting the vibration of the panel to the user's body.

BACKGROUND ART

Patent Literature 1 recites an electronic device, such as a mobile phone or the like, that transmits air-conducted sound and bone-conducted sound to a user. As the air-conducted sound, Patent Literature 1 recites a sound that is transmitted to the user's auditory nerve by air vibrations, caused by a vibrating object, that are transmitted through the external ear canal to the eardrum and cause the eardrum to vibrate. As the bone-conducted sound, Patent Literature 1 recites a sound that is transmitted to the user's auditory nerve through a portion of the user's body (such as the cartilage of the outer ear) that is contacting a vibrating object.

Patent Literature 1 recites a telephone in which a rectangular vibrating body, formed from a piezoelectric bimorph and a flexible substance, is attached to an outer surface of a housing via an elastic member. Patent Literature 1 also discloses that when voltage is applied to the piezoelectric bimorph in the vibrating body, the piezoelectric material expands and contracts in the longitudinal direction, causing the vibrating body to undergo bending vibration. Air-conducted sound and bone-conducted sound are transmitted to the user when the user contacts the vibrating body to the auricle.

CITATION LIST

Patent Literature 1: JP2005348193A

SUMMARY

In the electronic device recited in Patent Literature 1, no consideration is made of sound leakage due to vibration of the vibrating body being transmitted to the housing and causing the housing to vibrate.

Embodiments have been conceived in light of the above problems, to provide an electronic device that can reduce sound leakage due to vibration of the housing.

An electronic device according to one embodiment includes a piezoelectric element; a panel holding the piezoelectric element; a housing holding the panel and transmitting vibration through the panel, such that the electronic device causing the panel to generate and vibration sound that is transmitted by vibrating a part of a human body; and a stiffness varying portion in which a stiffness of the housing varies. The panel may further generate air-conducted sound.

The stiffness varying portion may be formed by varying a thickness of the housing.

The thickness of the housing may be varied by cyclically or randomly surface texturing the housing.

The thickness of the housing may be varied by one or more grooves formed on a surface of the housing.

The one or more grooves may comprise a plurality of grooves forming a grid.

The stiffness varying portion may be constituted by one or more ribs provided on the housing and formed separately from or integrally with the housing.

The one or more ribs may be provided on the housing in a direction intersecting a direction that extends away from the piezoelectric element.

The one or more ribs may each be straight or arc-shaped.

The one or more ribs may be disposed on an inner face of the housing.

The piezoelectric element may be disposed at one end of the housing.

The housing may be rectangular in plan view, and a length of two opposing sides of the housing may be equal to or greater than a length from an antitragus to an inferior antihelix crus.

A length of the other two opposing sides of the housing may be equal to or greater than a length from a tragus to an antihelix.

The piezoelectric element may be fixedly joined to the panel by a joining member.

The joining member may be a non-heat hardening adhesive.

The joining member may be double-sided tape.

The panel may be joined to the housing by a joining member.

The joining member joining the panel and the housing may be a non-heat hardening adhesive.

The joining member joining the panel and the housing may be double-sided tape.

The panel may constitute a portion or an entirety of any one of a display unit, an input unit, a cover for the display unit and a lid that allows for removal of a rechargeable battery.

A fixed portion of the piezoelectric element in the panel may be positioned outside of a region overlapping a display unit in plan view of the panel.

BRIEF DESCRIPTION OF DRAWINGS

Embodiments will be further described below with reference to the accompanying drawings, wherein.

DESCRIPTION OF EMBODIMENTS

Figure 1:
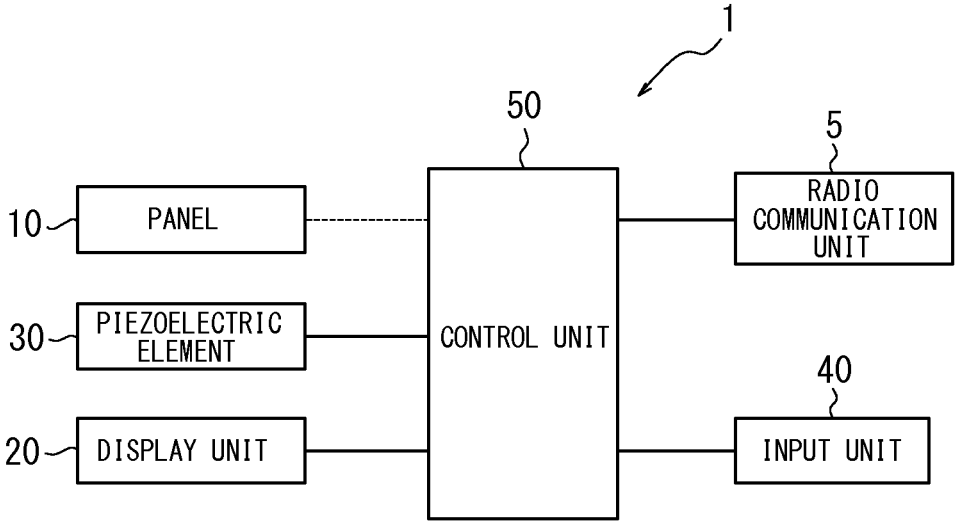
FIG. 1 is a functional block diagram of the main parts of an electronic device according to an embodiment.

Embodiments of the present invention will be described in detail with reference to the accompanying drawings. FIG. 1 is a functional block diagram of the main parts of an electronic device 1 according to an embodiment. The electronic device 1 is, for example, a mobile phone and is provided with a radio communication unit 5, a panel 10, a display unit 20, a piezoelectric element 30, an input unit 40 and a control unit 50. The radio communication unit 5 may be configured to be connected by radio to a base station or the like over a communication network. In the present embodiment, the electronic device 1 functions as a mobile phone such that the piezoelectric element 30 causes vibration of the panel 10, thereby sound transmitted through a human body is generated. The sound transmitted through a human body (or, human body vibration sound) vibrates the middle ear or the inner year through soft tissues (for example, the cartilage).

The panel 10 is a touch panel that detects contact or is a cover panel or the like that protects the display unit 20. The panel 10 may be, for example, made from glass or a synthetic resin such as acrylic or the like. The panel 10 is preferably plate-like in shape. When the panel 10 is a touch panel, the panel 10 detects contact by the user's finger, a pen, a stylus pen or the like. Any detection system may be used in the touch panel, such as a capacitive system, a resistive film system, a surface acoustic wave system (or an ultrasonic wave system), an infrared system, an electromagnetic induction system, a load detection system or the like.

The display unit 20 is a display device such as a liquid crystal display, an organic EL display, an inorganic EL display or the like. The display unit 20 is provided at the back side of the panel 10. The display unit 20 is disposed on the back face of the panel 10 by a joining member (for example, adhesive). The display unit 20 may be disposed at a distance from the panel 10 and supported by the housing of the electronic device 1.

The piezoelectric element 30 is formed by elements that, upon application of an electric signal (voltage), either expand and contract or flex in accordance with the electromechanical coupling coefficient of their constituent material. Ceramic or crystal elements, for example, may be used. The piezoelectric element 30 may be a unimorph, bimorph or laminated piezoelectric element. A laminated piezoelectric element includes a laminated bimorph element with layers of bimorph (for example, 16 or 24 layers). Such a laminated piezoelectric element may be constituted by a laminated structure formed by a plurality of dielectric layers composed of, for example, lead zirconate titanate (PZT) and electrode layers disposed between the dielectric layers. Unimorph expands and contracts upon the application of an electric signal (voltage), and bimorph flexes upon the application of an electric signal (voltage).

The piezoelectric element 30 is disposed on the back face of the panel 10 (the face on the inner side of the electronic device 1). The piezoelectric element 30 is attached to the panel 10 by a joining member (for example, double-sided tape). The piezoelectric element 30 may be attached to the panel 10 with an intermediate member (for example, sheet metal) therebetween. Once disposed on the back face of the panel 10, the piezoelectric element 30 is separated from the inner surface of the housing by a predetermined distance. The piezoelectric element 30 is preferably separated from the inner surface of the housing by the predetermined distance even when expanding and contracting or flexing. In other words, the distance between the piezoelectric element 30 and the inner surface of the housing is preferably larger than the maximum amount of deformation of the piezoelectric element 30.

The input unit 40 accepts operation input from the user and may be constituted, for example, by operation buttons (operation keys). Note that when the panel 10 is a touch panel, the panel 10 can also accept operation input from the user by detecting contact by the user.

The control unit 50 is a processor that controls the electronic device 1. The control unit 50 applies a predetermined electric signal (a voltage corresponding to an audio signal, such as the other party's voice, music including ringtones or songs, or the like) to the piezoelectric element 30. Note that the audio signal may be based on music data stored in internal memory, or may be music data stored on an external server or the like and played back over the network.

Upon application of the electric signal, the piezoelectric element 30 expands and contracts or flexes in the longitudinal direction. At this point, the panel 10 to which the piezoelectric element 30 is attached deforms in conjunction with the expansion and contraction or flexing of the piezoelectric element 30. The panel 10 thus undergoes flexure vibration. The panel 10 is directly bent by the piezoelectric element 30. The panel 10 being directly bent by the piezoelectric element 30 differs from a phenomenon adapted to a conventional panel speaker, such that inertia force of a piezoelectric actuator having a piezoelectric element disposed within a case causes vibration added to a certain region of the panel, and thereby the panel is deformed. The panel 10 being directly bent by the piezoelectric element 30 includes a meaning that expansion and contraction or bend (flex) of a piezoelectric element directly bends a panel via a joint member or via a joint member and an appropriately used reinforcement member. Here, the maximum voltage of the electric signal that the control unit 50 applies to the piezoelectric element 30 may, for example, be ±15 V. This is higher than ±5 V, i.e. the applied voltage of the so-called panel speaker for conduction of air-conducted sound, which does not transmit vibration sound. In this way, even if the user presses the panel 10 against the user's body with, for example, a force of 3 N or greater (e.g. 5 N to 10 N), sufficient flexure vibration is generated in the panel 10, so that a vibration sound can be generated via a part of the user's body (such as the cartilage of the outer ear). Note that the magnitude of the applied voltage used may be appropriately adjusted for the fixation strength of the panel, the performance of the element and other such factors.

The panel 10 undergoes flexure vibration not only in the region in which the piezoelectric element 30 is attached, but also in a region separate from the attachment region. In the region of vibration, the panel 10 includes a plurality of locations at which the panel 10 vibrates in a direction intersecting the main surface of the panel. At each of these locations, the value of the vibration amplitude changes over time from positive to negative or vice-versa. At a given instant during vibration of the panel 10, portions with a relatively large vibration amplitude and portions with a relatively small vibration amplitude appear to be distributed randomly or cyclically over nearly the entire panel 10. In other words, a plurality of vibration waves are detected across the entire panel 10. The maximum voltage that the control unit 50 applies to the piezoelectric element 30 may be ±15 V to prevent dampening of the above-described vibration of the panel 10 even if the user presses the panel 10 against the user's body with a force of, for example, 5 N to 10 N. Therefore, the user can hear sound by having the panel 10 contact the ear at a region distant from the above-described attachment region of the piezoelectric element 30.

Figure 2:
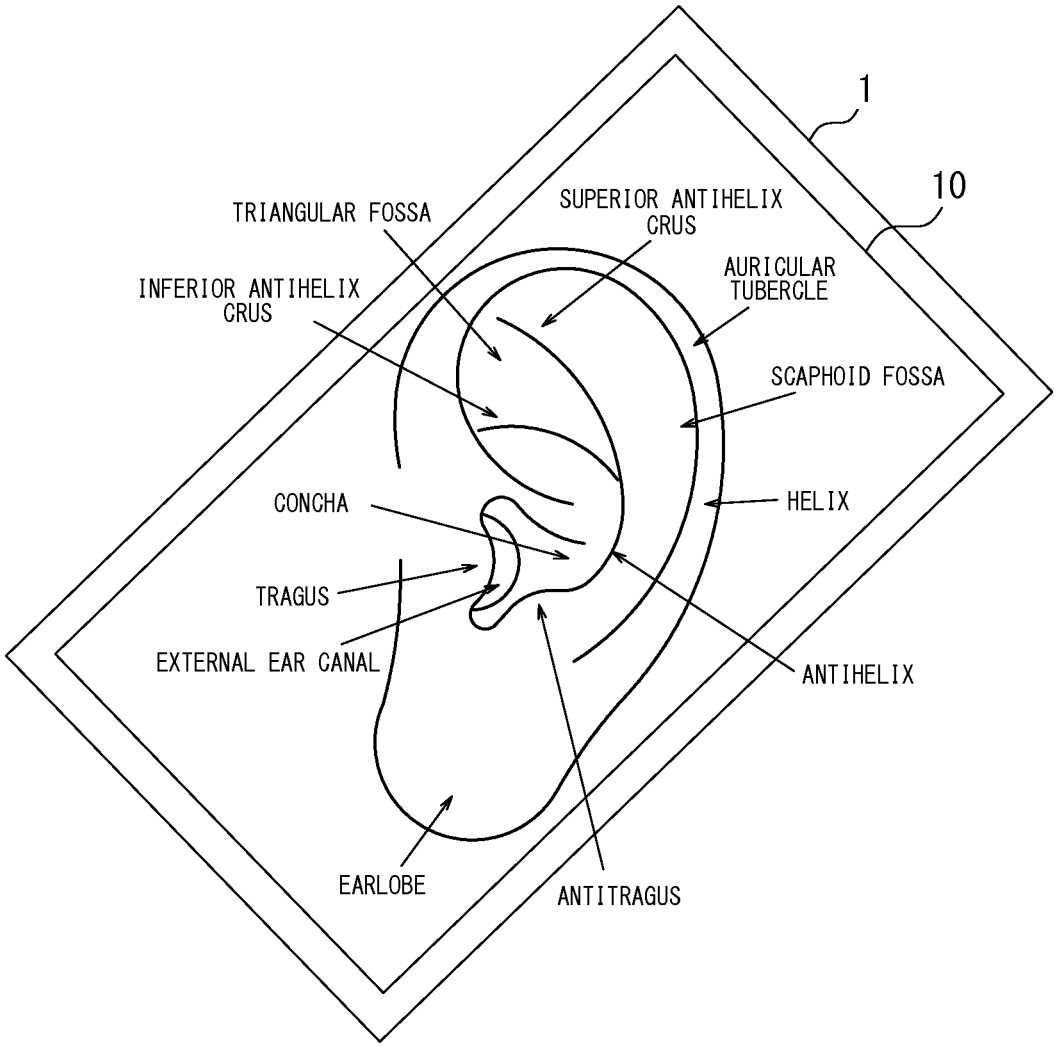
FIG. 2 illustrates a configuration of a panel.

The panel 10 may be nearly the same size as the user's ear. As illustrated in FIG. 2, the panel 10 may also be larger than the user's ear. Adopting such a size makes it easier for the panel 10 of the electronic device 1 to cover the entire ear when the user listens to sound, thus making it difficult for surrounding sounds (noise) to enter the external ear canal. The region of the panel 10 that vibrates should be larger than a region having a length corresponding to the distance from the inferior antihelix crus to the antitragus and a width corresponding to the distance from the tragus to the antihelix. The region of the panel 10 that vibrates preferably has a length corresponding to the distance from a position in the helix near the superior antihelix crus to the earlobe and a width corresponding to the distance from the tragus to a position in the helix near the antihelix. The region with the above length and width may be a rectangular region or may be an elliptical region with the above length as the major axis and the above width as the minor axis. The average size of a Japanese person's ear can be looked up in sources such as the Japanese Body Dimension Data (1992-1994) gathered by the Research Institute of Human Engineering for Quality Life (HQL). Note that if the panel 10 is larger than the average size of a Japanese person's ear, it is thought that the panel 10 will be a size capable of covering the entire ear of most non-Japanese people. With the above-described dimensions and shape, the panel 10 can cover the user's ear and has tolerance for misalignment when placed against the ear.

By vibration of the panel 10, the electronic device 1 can transmit vibration sound through a part of the user's body (such as the cartilage of the outer ear) and air-conducted sound to the user. Therefore, when sound is output at a volume equivalent to a conventional dynamic receiver, the sound that is transmitted to the periphery of the electronic device 1 by air vibrations due to vibration of the panel 10 is smaller than with a dynamic speaker. Accordingly, the electronic device 1 is appropriate for listening to recorded messages, for example, on the train or the like.

Furthermore, the electronic device 1 transmits vibration sound by vibration of the panel 10, and therefore even if the user is wearing earphones or headphones, the user can hear sound through the earphones or headphones and through a part of the body by contacting the electronic device 1 against the earphones or headphones.

The above electronic device 1 transmits sound to a user by vibration of the panel 10. Therefore, if the electronic device 1 is not provided with a separate dynamic speaker, it is unnecessary to form an opening (sound discharge port) for sound transmission in the housing, thereby simplifying waterproof construction of the electronic device 1. On the other hand, if the electronic device 1 is provided with a dynamic speaker, the sound discharge port should be blocked by a member permeable by air but not liquid. Gore-Tex (registered trademark) is an example of a member permeable by air but not liquid.

[Embodiment 1]

Figure 3A:
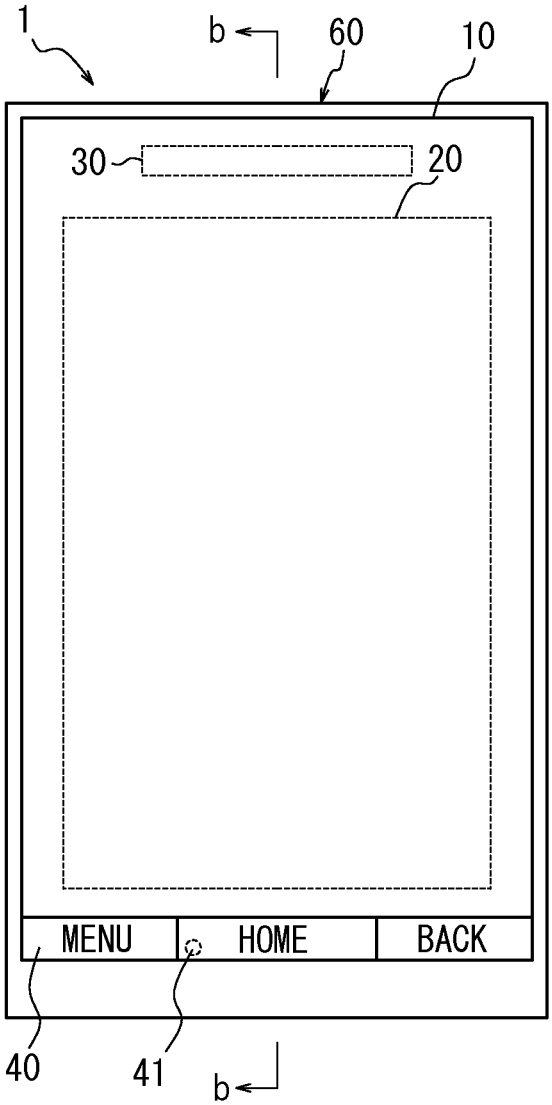
FIGS. 3A and 3B schematically illustrate the main parts of a housing structure of the electronic device according to Embodiment 1.
Figure 3B:
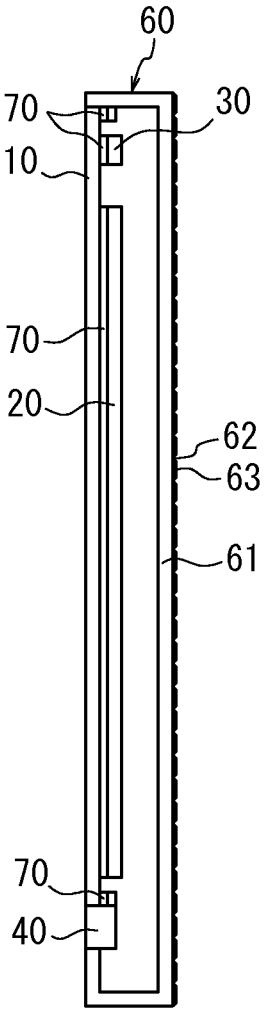

FIGS. 3A and 3*b* schematically illustrate the main parts of a housing structure of the electronic device 1 according to Embodiment 1. FIG. 3A is a front view, and FIG. 3B is a cross-sectional view along the b-b line of FIG. 3A. The electronic device 1 illustrated in FIGS. 3A and 3B is a smartphone in which a rectangular glass plate is disposed on the front face of a housing 60 (e.g. a metal or resin case) as the panel 10.

The panel 10 constitutes a capacitive-type touch panel, for example, and is supported by the housing 60 with a joining member 70 therebetween. The display unit 20 is joined to the panel 10 by the joining member 70 along the back face thereof, except at one end (upper part) in the longitudinal direction. The piezoelectric element 30 is joined to the panel 10 by the joining member 70 at the upper part of the back face of the panel 10, i.e. at one end thereof. The piezoelectric element 30 is rectangular and is joined with the long side thereof along the short side of the panel 10. Note that the joining member 70 is thermosetting or ultraviolet curable adhesive, double-sided tape or the like. The joining member 70 may, for example, be optical elasticity resin, which is clear and colorless acrylic ultraviolet curing adhesive.

The input unit 40 is supported by the housing 60 at the other end (lower part) in the longitudinal direction of the panel 10. A mouthpiece 41 of a microphone is formed in the input unit 40, as indicated by the dashed line. In other words, the piezoelectric element 30 is disposed at the upper end of the rectangular housing 60, and the mouthpiece 41 is formed at the lower end.

Figure 4A:
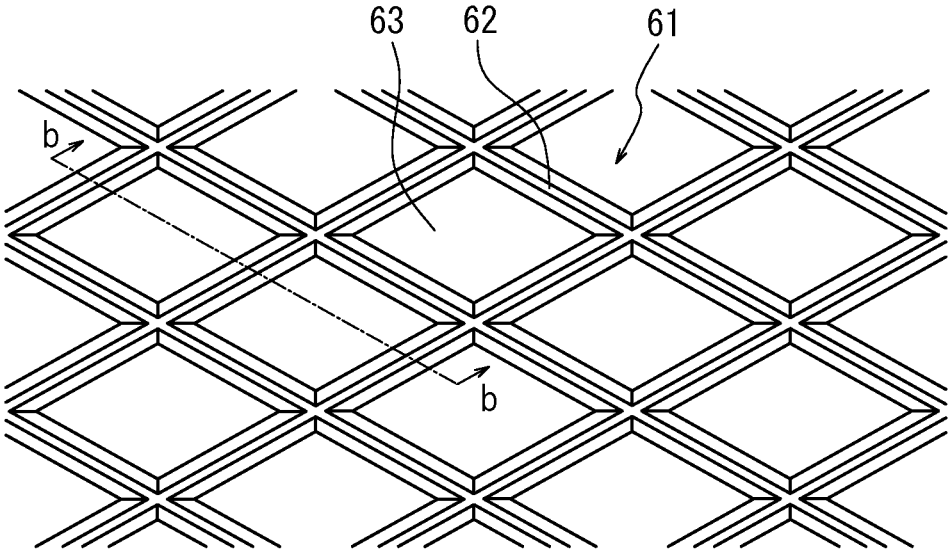
FIGS. 4A and 4B illustrate the structure of a stiffness varying portion in a rear case of the electronic device according to Embodiment 1.
Figure 4B:
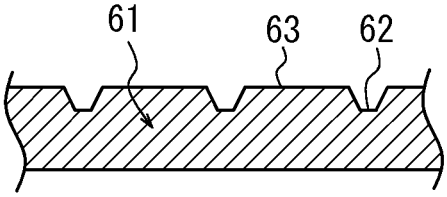

On the outer surface of a rear case 61 of the housing 60, a plurality of grooves 62 that constitute a stiffness varying portion are formed in a grid, as illustrated by the partial perspective view in FIG. 4A and the cross-sectional view in FIG. 4B along the b-b line of FIG. 4A. Specifically, in the rear case 61, the thickness of the grooves (concavities) 62 is less than that of other portions (convexities) 63, and the stiffness of the convexities 63 is greater than the stiffness of the concavities 62.

Figure 5:
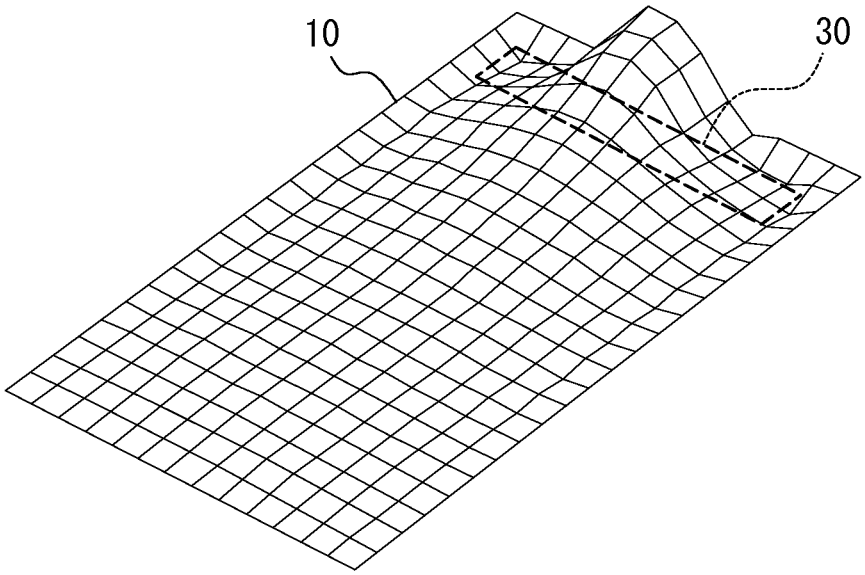
FIG. 5 illustrates an example of vibration of the panel in the electronic device according to Embodiment 1.

FIG. 5 illustrates an example of vibration of the panel 10 in the electronic device 1 according to Embodiment 1. In the electronic device 1 according to Embodiment 1, the display unit 20 is attached to the panel 10. The stiffness of the lower part of the panel 10 thus increases, making it possible to cause the upper part of the panel 10, where the piezoelectric element 30 is attached, to vibrate more than the lower part of the panel 10. The panel 10 is directly bent in its upper portion by the piezoelectric element 30, and vibration is dampened in the lower portion compared to the upper portion. The panel 10 is bent by the piezoelectric element 30 in the direction along the long side of the piezoelectric element 30 such that the portion of the panel 10 immediately above the piezoelectric element 30 rises higher than the adjacent portions. As a result, sound leakage due to vibration of the lower part of the panel 10 is reduced at the lower part of the panel 10.

According to the electronic device 1 of the present embodiment, the panel 10 thus deforms in conjunction with deformation of the piezoelectric element 30 attached to the back face of the panel 10, thereby vibrating sufficiently in a region from the end in the longitudinal direction, at which the piezoelectric element 30 is adhered, to near the central part of the panel 10. Accordingly, by having a part of the body (such as the cartilage of the outer ear) contact to at least a portion of the region from the central part to the upper part of the panel 10, the user can hear air-conducted sound and vibration sound caused by vibration of the panel 10. As a result, air-conducted sound and vibration sound can be transmitted to the user without projecting the vibrating body from the outer surface of the housing 60, thereby improving usability over the electronic device disclosed in Patent Literature 1, in which a vibrating body extremely small as compared to the housing is pressed against the user's body. The piezoelectric element 30 also does not damage easily, since the user's ear need not be pressed against the piezoelectric element itself. Moreover, causing the housing 60 rather than the panel 10 to deform makes it easier for the user to drop the terminal when vibration is generated. By contrast, vibrating the panel 10 prevents this problem.

In the present embodiment, the display unit 20 and the piezoelectric element 30 are joined to the panel 10 by the joining member 70. The display unit 20 and piezoelectric element 30 can thus be attached to the panel 10 without restricting the degree of freedom for deformation of the display unit 20 and the piezoelectric element 30. The joining member 70 may be a non-heat hardening adhesive. Such adhesive has the advantage that, during hardening, thermal stress contraction does not easily occur between the panel 10 and the display unit 20 or piezoelectric element 30. The joining member 70 may also be double-sided tape. Such tape has the advantage that the contraction stress when using adhesive is not easily produced between the panel 10 and the display unit 20 or piezoelectric element 30. Similar effects are also obtained for the panel 10, since the panel 10 is joined to the housing 60 by the joining member 70. Additionally, vibration of the panel 10 is not easily transmitted directly to the rear case 61 of the housing 60, thereby reducing the risk of the user dropping the electronic device 1 as compared to when the housing itself vibrates significantly.

Figure 6A:
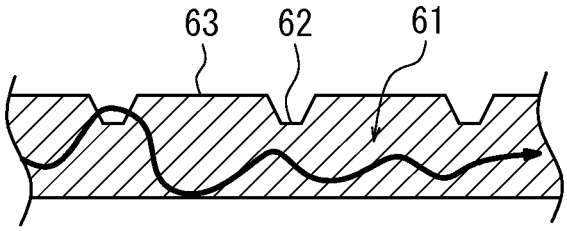
FIGS. 6A and 6B illustrate a vibration dampening effect by the rear case of the electronic device according to Embodiment 1.
Figure 6B:
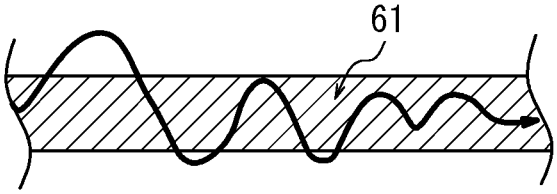

Since the stiffness varying portion formed from a grid of concavities and convexities is provided on the rear case 61 of the housing 60, the convexities 63 have greater stiffness than the concavities (grooves) 62. Therefore, as illustrated by a comparison between FIGS. 6A and 6B, the stiffness varying portion can effectively dampen vibrations of the rear case 61 upon vibration of the piezoelectric element 30 at the same amplitude, thereby reducing sound leakage from the rear case 61. The vibration of the rear case 61 due to the piezoelectric element 30 can thus be reduced, thereby reducing the risk of the user dropping the electronic device 1. Note that FIG. 6A shows a state of dampening vibrations of the rear case 61 in the present embodiment, whereas FIG. 6B shows a state of dampening vibrations when the rear case 61 has a uniform thickness equal to the thickness of the concavities 62 in FIG. 6A. Furthermore, since the stiffness varying portion of the rear case 61 is formed by concavities (grooves) 62 on the rear case 61, the stiffness varying portion can be easily configured.

[Embodiment 2]

Figure 7A:
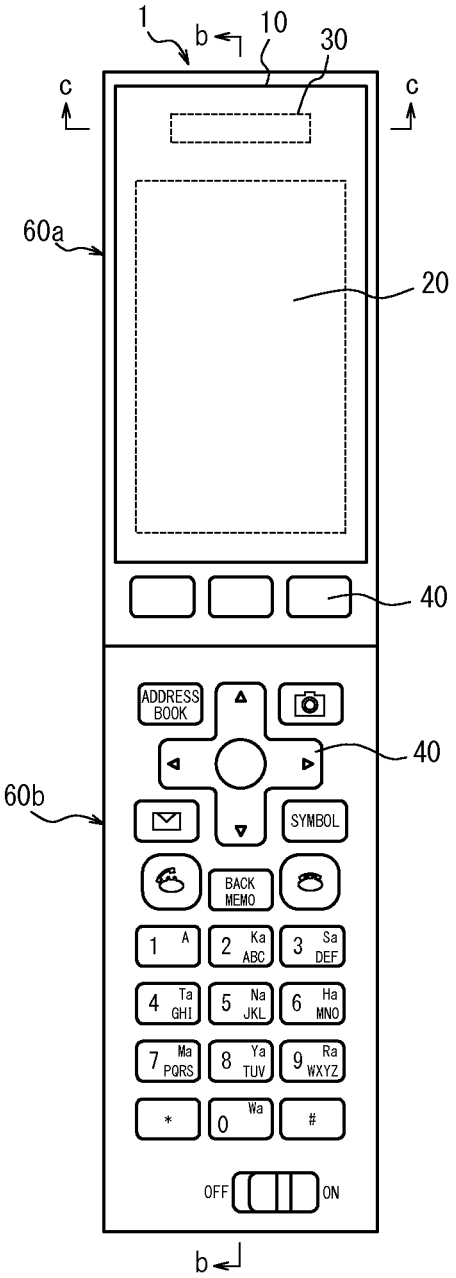
FIGS. 7A-7C schematically illustrate the main parts of a housing structure of an electronic device according to Embodiment 2.
Figure 7B:
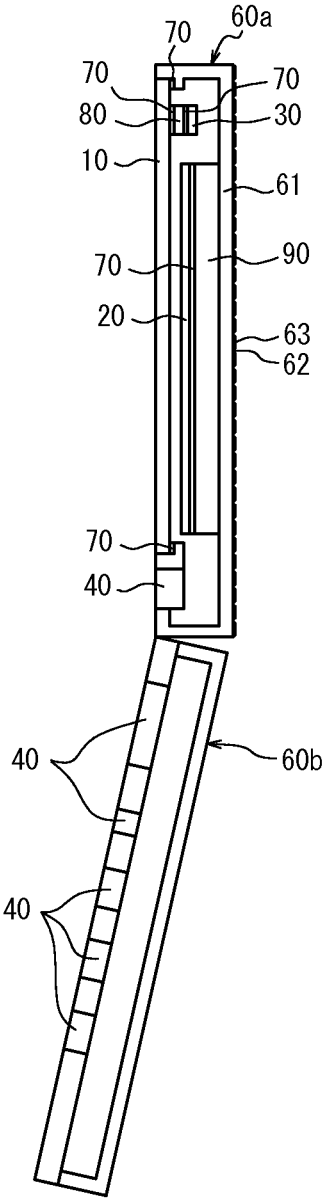
Figure 7C:
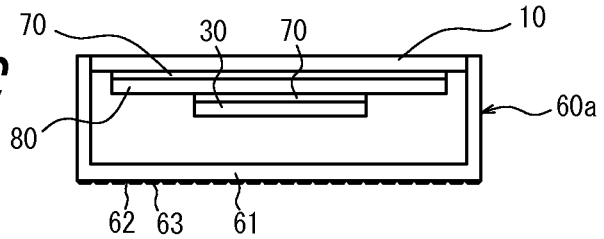

FIGS. 7A-7C schematically illustrate the main parts of a housing structure of the electronic device 1 according to Embodiment 2. FIG. 7A is a front view, FIG. 7B is a cross-sectional view along the b-b line of FIG. 7A, and FIG. 7C is a cross-sectional view along the c-c line of FIG. 7A. The electronic device 1 illustrated in FIGS. 7A-7C is a clamshell mobile phone in which a cover panel (an acrylic plate) protecting the display unit 20 is disposed on the front face of an upper housing 60*a* as the panel 10, with the input unit 40 disposed on a lower housing 60*b*.

In Embodiment 2, a reinforcing plate 80 that is larger than the piezoelectric element 30 is disposed between the panel 10 and the piezoelectric element 30. The reinforcing plate 80 is, for example, a resin plate, sheet metal, or a plate including glass fibers. In other words, in the electronic device 1 according to Embodiment 2, the piezoelectric element 30 and the reinforcing plate 80 are adhered by the joining member 70, and furthermore the reinforcing plate 80 and the panel 10 are adhered by the joining member 70.

Furthermore, in Embodiment 2, the display unit 20 is not adhered to the panel 10, but rather is supported by the housing 60*a*. Specifically, in the electronic device 1 according to Embodiment 2, the display unit 20 is separated from the panel 10 and adhered by the joining member 70 to a support 90, which is a portion of the housing 60*a*. Note that the support 90 is not restricted to being a portion of the housing 60*a* and may be a member formed from metal, resin or the like and independent from the housing 60*a*.

As in Embodiment 1, the outer surface of the rear case 61 of the housing 60*a*, where the piezoelectric element 30 is contained, has a stiffness varying portion constituted by a grid of concavities and convexities formed by grooves (concavities) 62. The stiffness of the convexities 63 is greater than that of the concavities 62.

Figure 8:
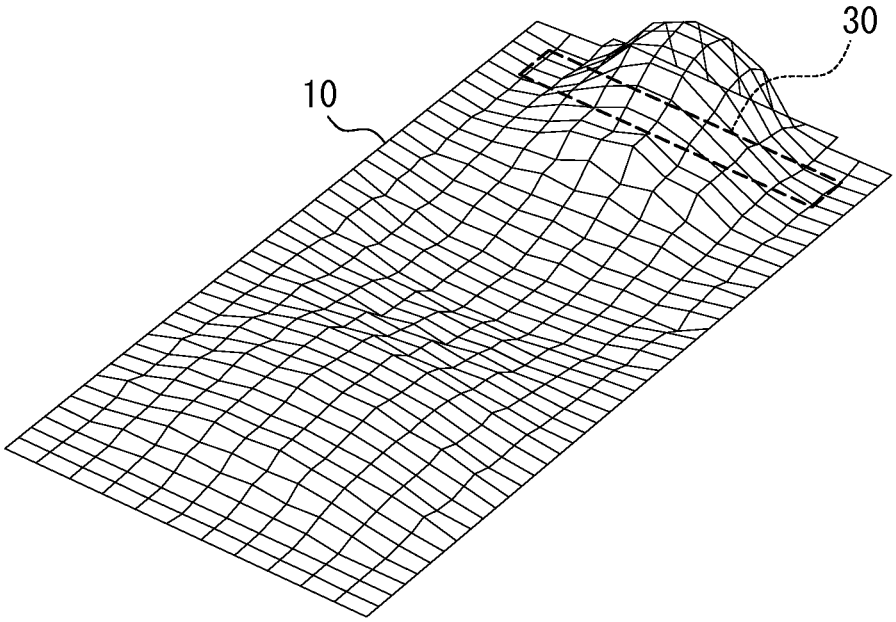
FIG. 8 illustrates an example of vibration of a panel in the electronic device according to Embodiment 2.

FIG. 8 illustrates an example of vibration of the panel 10 in the electronic device 1 according to Embodiment 2. In the electronic device 1 according to Embodiment 2, the panel 10 is an acrylic plate with lower stiffness than a glass plate, and the display unit 20 is not adhered to the back face of the panel 10. Therefore, as compared to the electronic device 1 according to Embodiment 1 illustrated in FIG. 5, the amplitude produced by the piezoelectric element 30 is greater. The panel 10 vibrates not only in the region in which the piezoelectric element 30 is attached, but also in a region separate from the attachment region. Therefore, in addition to air-conducted sound, the user can hear vibration sound by the ear contacting any position on the panel 10. The panel 10 is directly bent in its upper portion by the piezoelectric element 30, and vibration is dampened in the lower portion compared to the upper portion. The panel 10 is bent by the piezoelectric element 30 in the direction along the long side of the piezoelectric element 30 such that the portion of the panel 10 immediately above the piezoelectric element 30 rises higher than the adjacent portions.

In the electronic device 1 according to the present embodiment, the reinforcing plate 80 and the panel 10 deform in conjunction with deformation of the piezoelectric element 30 attached to the panel 10 via the reinforcing plate 80, so that air-conducted sound and vibration sound are transmitted to an object that contacts the deforming panel 10. As a result, air-conducted sound and vibration sound may be transmitted to the user without the user's ear being pressed against the vibrating body itself. Furthermore, the piezoelectric element 30 is attached to the surface of the panel 10 facing the inside of the housing 60*a*. Air-conducted sound and vibration sound may thus be transmitted to the user without projecting the vibrating body from the outer surface of the housing 60*a*. Moreover, the panel 10 deforms not only in the region in which the piezoelectric element 30 is attached, but rather throughout the panel 10 in order to transmit air-conducted sound and vibration sound. Therefore, in addition to air-conducted sound, the user may hear vibration sound by the ear contacting any position on the panel 10.

Disposing the reinforcing plate 80 between the piezoelectric element 30 and the panel 10 can reduce the probability of an undesired external force being transmitted to and damaging the piezoelectric element 30 if, for example, such a force is applied to the panel 10. Moreover, even if the panel 10 is pressed firmly against the user's body, vibrations of the panel 10 do not dampen easily. By disposing the reinforcing plate 80 between the piezoelectric element 30 and the panel 10, the resonance frequency of the panel 10 also decreases, thereby improving the acoustic characteristics in the low frequency band. Note that instead of the reinforcing plate 80, a plate-shaped anchor may be attached to the piezoelectric element 30 by the joining member 70.

As in Embodiment 1, the outer surface of the rear case 61 of the housing 60*a*, where the piezoelectric element 30 is contained, has a stiffness varying portion constituted by a grid of concavities and convexities, and the stiffness of the convexities 63 is greater than that of the concavities 62. Accordingly, as in Embodiment 1, sound leakage from the rear case 61 can be reduced. Furthermore, since the stiffness varying portion of the rear case 61 is formed by concavities (grooves) 62 on the rear case 61, the stiffness varying portion can be easily configured.

Although the present invention has been described by way of embodiments with reference to the accompanying drawings, it is to be noted that various changes and modifications will be apparent to those skilled in the art. Therefore, such changes and modifications are to be understood as included within the scope of the present invention. For example, the functions and the like included in the various members and steps may be reordered in any logically consistent way. Furthermore, components or steps may be combined into one or divided.

Figure 9:
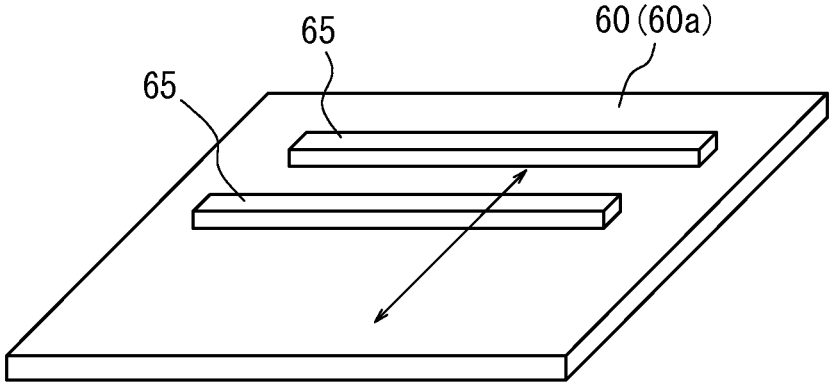
FIG. 9 illustrates a modification to the stiffness varying portion.

The grooves (convexities) forming the stiffness varying portion are not restricted to a plurality of grooves forming a grid. Alternatively, one groove or a plurality of grooves in parallel may be provided in accordance with the amount of reduction of sound leakage. The stiffness varying portion can also be formed by cyclically or randomly surface texturing the housing 60 (60*a*) to vary the thickness of the housing 60 (60*a*), or by providing the housing 60 (60*a*) with one or more ribs formed separately from or integrally with the housing 60 (60*a*). This simplifies the configuration of the stiffness varying portion. Note that when the stiffness varying portion is formed by one or more ribs, the ribs are provided on the housing 60 (60*a*) in a direction intersecting a direction that extends away from the piezoelectric element, each rib being straight or arc-shaped. FIG. 9 illustrates an example of two straight ribs 65 provided on the housing 60 (60*a*) in a direction intersecting a direction that extends away from the piezoelectric element (as illustrated by the double-headed arrow). The stiffness varying portion is not limited to being provided on the outer surface of the rear case 61 and instead may be provided on the inner surface or on both surfaces.

Furthermore, when the panel 10 and the display unit 20 do not overlap, the piezoelectric element 30 may be disposed at the center of the panel 10. When the piezoelectric element 30 is disposed at the center of the panel 10, vibration of the piezoelectric element 30 is transmitted across a wide range of the panel 10, for example the entire panel 10, thereby improving quality of air-conducted sound and permitting recognition of bone-conducted sound when the user's ear contacts any of various positions on the panel 10. A plurality of piezoelectric elements 30 may also be provided. Alternatively, the piezoelectric element may be disposed at the corner of the housing. Transmission of vibration sound can thus center on the corner, allowing the user to hear vibration sound by pressing the ear against the corner of the housing.

The piezoelectric element 30 is attached to the panel 10 in the above electronic device 1 but instead may be attached to a location other than the panel 10. For example, in Embodiment 1, the piezoelectric element 30 may be attached to the housing 60 or to a battery lid that covers a battery. Since the battery lid is often attached to a different face than the panel 10 in the electronic device 1 of a mobile phone or the like, according to this structure the user can hear sound by a part of the body (such as the ear) contacting a different face than the panel 10.

Furthermore, the panel 10 may constitute a portion or the entirety of any of a display panel, an operation panel, a cover panel, or a lid panel that allows for removal of a rechargeable battery. In particular, when the panel 10 is a display panel, the piezoelectric element 30 is disposed on the outside of a display region fulfilling a display function. This offers the advantage of not blocking the display. The operation panel includes the touch panel of Embodiment 1. The operation panel also includes a sheet key, in which the tops of operation keys are integrally formed in, for example, a clamshell mobile phone so as to constitute one face of the housing alongside an operation unit.

Note that in Embodiments 1 and 2, the joining member that adheres the panel 10 and the piezoelectric element 30 and the joining member or the like that adheres the panel 10 and the housing 60 (60*a*) have both been described as the joining member 70, using the same reference numeral. The joining members used in Embodiments 1 and 2, however, may differ as needed in accordance with the components being joined.

REFERENCE SIGNS LIST

1: Electronic device
5: Radio communication unit
10: Panel
20: Display unit
30: Piezoelectric element
40: Input unit
41: Mouthpiece
50: Control unit
60, 60*a*, 60*b*: Housing
61: Rear case
62: Groove (concavity)
63: Convexity
65: Rib
70: Joining member
80: Reinforcing plate
90: Support

The invention claimed is:

1. An electronic device comprising:

a piezoelectric element having a long shape which flexes in a longitudinal direction;

a panel which holds the piezoelectric element and thereby flexes at least in the longitudinal direction of the piezoelectric element;

a housing holding the panel, the housing including a rear case and an interior positioned between the panel and the rear case, the rear case including an internal face facing the interior and an external face facing an exterior of the electronic device;

a first joining member in contact with the piezoelectric element on a first face of the first joining member and with the panel on a second face of the first joining member;

a second joining member in contact with a periphery of the panel on a face of the second joining member and with a periphery of the housing; and a groove and/or a rib, which extend(s) in the longitudinal direction of the piezoelectric element, being disposed on the external face of the rear case of the housing facing the exterior of the electronic device, generating a vibration sound by transmitting vibration to an ear in contact with the flexing panel, wherein the vibration sound is generated by the panel.

2. The electronic device according to claim 1, wherein the groove and/or the rib is formed by varying a thickness of the housing.

3. The electronic device according to claim 2, wherein the thickness of the housing is varied by cyclically or randomly surface texturing the housing.

4. The electronic device according to claim 2, wherein the thickness of the housing is varied by one or more grooves formed on a surface of the housing.

5. The electronic device according to claim 1, wherein the groove and/or the rib is constituted by a rib formed separately from or integrally with the housing.

6. The electronic device according to claim 5, wherein one or more ribs are disposed on an inner face of the housing.

7. The electronic device according to claim 1, wherein the housing is rectangular in plan view, and a length of two opposing sides of the housing is equal to or greater than a length from an antitragus to an inferior antihelix crus.

8. The electronic device according to claim 7, wherein a length of the other two opposing sides of the housing is equal to or greater than a length from a tragus to an antihelix.

9. The electronic device according to claim 1, wherein at least one of the first joining member and the second joining member is a non-heat hardening adhesive.

10. The electronic device according to claim 1, wherein at least one of the first joining member and the second joining member is double-sided tape.

11. The electronic device according to claim 1, wherein the panel constitutes a portion or an entirety of any one of a display unit, an input unit, a cover for the display unit and a lid that allows for removal of a rechargeable battery.

12. The electronic device according to claim 1, wherein a fixed portion of the piezoelectric element in the panel is positioned outside of a region overlapping a display unit in plan view of the panel.

13. The electronic device according to claim 1, wherein the panel further generates air-conducted sound.

* * * * *